US005238269A

United States Patent [19]

Levine

[11] Patent Number: 5,238,269

[45] Date of Patent: Aug. 24, 1993

[54] SHEET MATERIAL INCORPORATING SMALLER AREAS DEFINED BY ELONGATED SLITS AND MEANS OF ATTACHMENT ENABLING PRINTING OF SAID SMALL AREAS WHILE STILL ATTACHED BUT AFTER SLITTING

[76] Inventor: William A. Levine, 2984 Fresno St., Santa Clara, Calif. 95051

[21] Appl. No.: 709,097

[22] Filed: May 30, 1991

[51] Int. Cl.[5] ..... B42D 1/00

[52] U.S. Cl. ..... 281/2; 281/5; 462/2; 462/3

[58] Field of Search ..... 281/2, 5; 462/6, 26, 462/32, 36, 37, 2, 3; 283/81

[56] References Cited

U.S. PATENT DOCUMENTS

| | | | |
|---|---|---|---|
| 2,696,991 | 12/1954 | Rieger | 281/5 |
| 4,010,964 | 3/1977 | Schechter | 283/56 |
| 4,529,227 | 7/1985 | Fields | 281/2 X |
| 4,624,482 | 11/1986 | Cassells | 283/62 |
| 4,735,437 | 4/1988 | Fattibene | 281/2 |
| 4,773,676 | 9/1988 | Showering | 281/2 |
| 4,802,692 | 2/1989 | Stryd | 281/2 X |
| 4,854,610 | 8/1989 | Kwiatek | 283/81 |
| 4,860,946 | 8/1989 | Brand | 462/6 X |
| 4,890,862 | 1/1990 | Buchholz | 283/62 |
| 4,952,433 | 8/1990 | Tezuka et al. | 428/42 |

*Primary Examiner*—Mark Rosenbaum
*Assistant Examiner*—Willmon Fridie, Jr.
*Attorney, Agent, or Firm*—John J. Leavitt

[57] ABSTRACT

In one aspect, an article of manufacture constituting a flat planar sheet of material having slits cut therethrough in selected patterns to define the configuration of a subsidiary portion of the flat planar sheet of material, while means of attachment are provided at each change of direction of the perimeter of the subsidiary portion of the sheet. Formed in the flat planar primary sheet of material are lines of flexibility formed by linear compression over a very limited area of the flat planar sheet of material to diminish its thickness along the lines of flexibility thereby permitting flexure of the planar sheet of material along the lines of flexibility. In a second aspect, there is provided a steel die for producing the article of manufacture, the die having uninterrupted knife edges that define the slits in the article of manufacture constituting the flat planar sheet of material, with small spaces provided between the ends of the elongated knife edges at each change of direction so as to provide in the planar sheet of material an uncut portion of the perimeter that integrally attaches the flat planar sheet to the subsidiary portion thereof, the configuration of which is defined by the slits. In a third aspect, there is presented a method for utilizing the article of manufacture in conjunction with a personal computer and a program loaded in the computer for instructing a computer-controlled printer to print selected indicia on the subsidiary portions of the flat planar sheet.

10 Claims, 3 Drawing Sheets

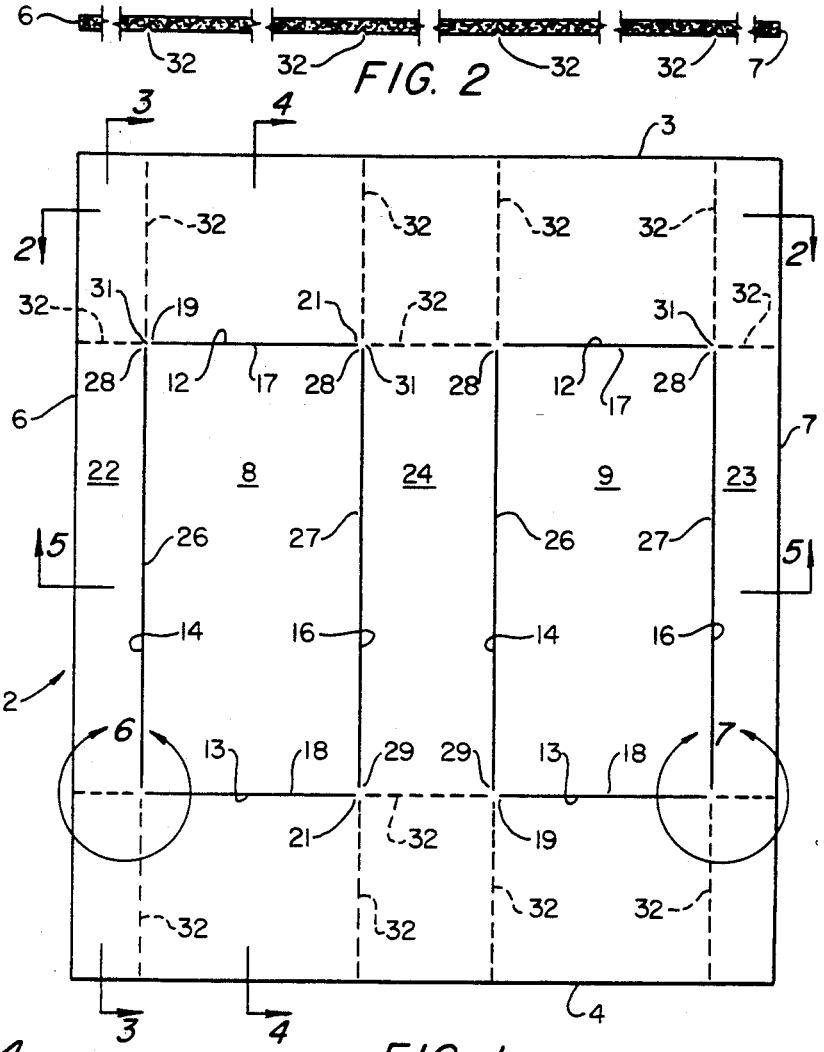
FIG. 2
FIG. 1
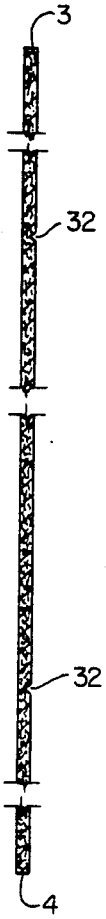
FIG. 3
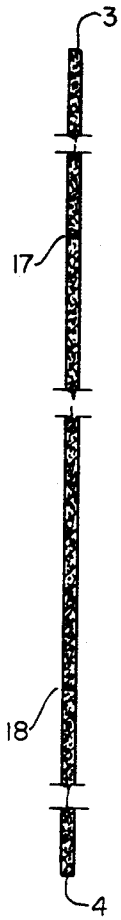
FIG. 4
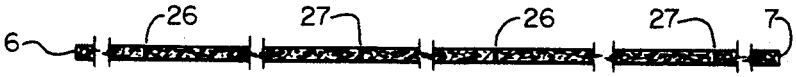
FIG. 5
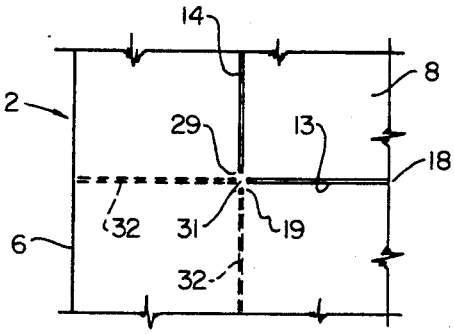
FIG. 6
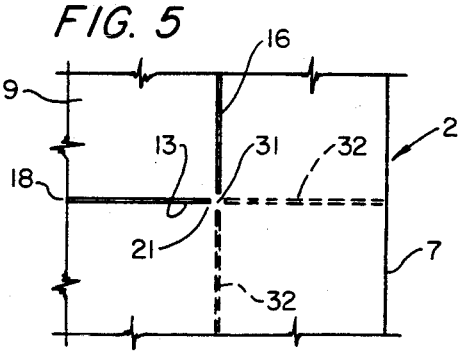
FIG. 7

FIG. 9
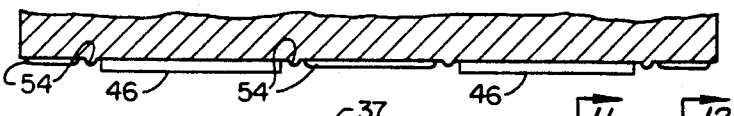
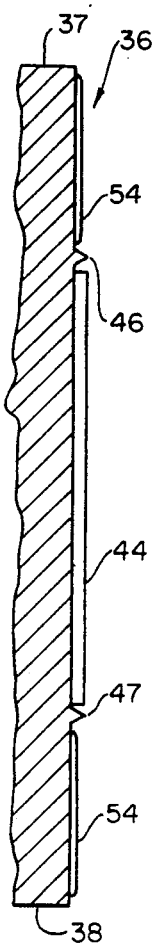
FIG. 11
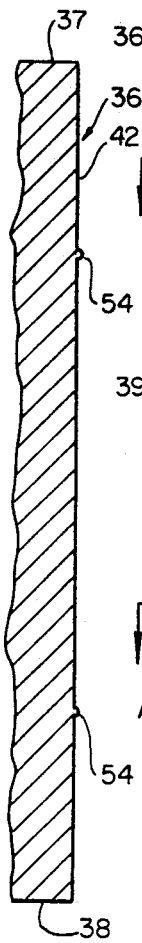
FIG. 12
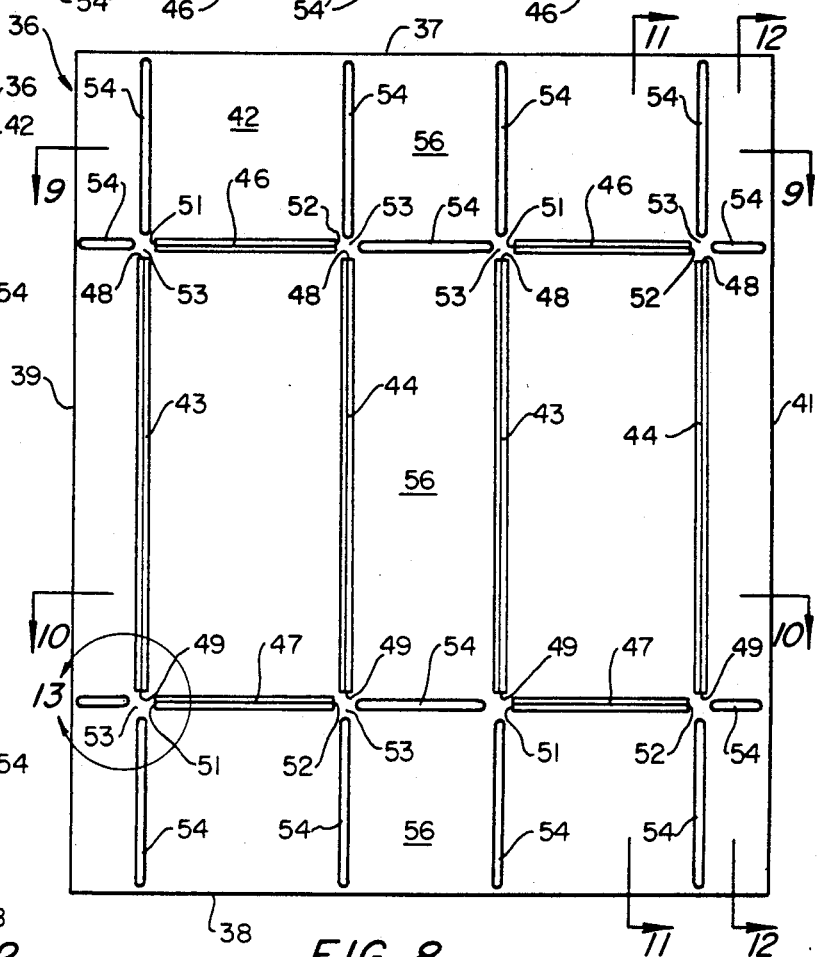
FIG. 8
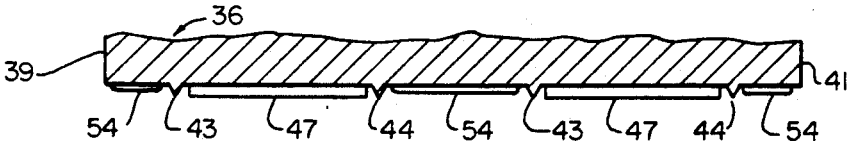
FIG. 10
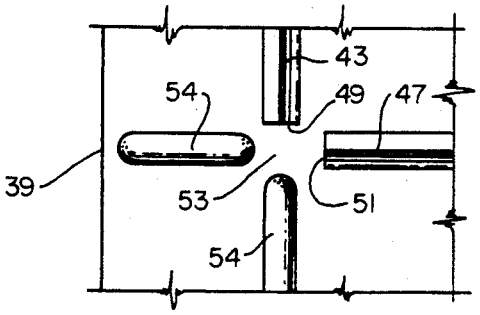
FIG. 13

SHEET MATERIAL INCORPORATING SMALLER AREAS DEFINED BY ELONGATED SLITS AND MEANS OF ATTACHMENT ENABLING PRINTING OF SAID SMALL AREAS WHILE STILL ATTACHED BUT AFTER SLITTING

BACKGROUND OF THE INVENTION

1. Field of the Invention

This invention relates in general to the printing industry, and more particularly to the production of a planar sheet of material of relatively large size at least one smaller area of which is defined in size and configuration by a perimeter including a plurality of elongated slits extending completely through the material and a plurality of means integrally attaching said smaller area to said relatively larger sheet of material, whereby the entire relatively larger sheet may be processed through a computer-controlled printer after formation of the elongated slits for the printing of indicia only on the smaller defined areas incorporated on the larger sheet of material and defined by the elongated slits and the attachment means.

2. Description of the Prior Art

A preliminary patentability and novelty search on this invention has revealed the existence of the following United States patents, none of which appear to be particularly relevant to the subject matter of the invention described herein.

| | | |
|---|---|---|
| 2,696,991 | 4,010,964 | 4,624,482 |
| 4,890,862 | | 4,952,433 |

Heretofore, the customary way to produce business cards, for example, was to define the content of the card and place an order with a printer for production of a quantity of the cards. At least three problems are almost always present in such a scenario. The first is the time frame within which it takes a printer to produce a printing or engraving die for the content to be printed on the card, second is the number of cards to be printed, and third is the cost of producing the cards. Under conventional methods of printing or engraving business cards, several weeks can be expended during which time the need for the cards persists, sometimes on an emergency basis. Sometimes only a few business cards are needed, but needed quickly and with the appearance of professionalism in the printing, such as when a new sales person is employed and immediately starts calling on potential customers. The sales person needs appropriate business cards immediately.

Accordingly, it is one of the principal objects of the present invention to provide a method and means by which professionally appearing business and other types of cards may be produced through use of a personal computer and a printer responsive to commands from the computer.

Heretofore, business cards have been printed on a large sheet, and the sheet then divided to separate the business cards into individual cards. This process requires special printing capabilities and equipment, and special cutting equipment for separating the cards. Accordingly, it is another object of the present invention to provide a planar sheet of material which has been processed prior to printing by substantial pre-cutting to define smaller areas defined by elongated slits spaced at associated ends by integral attachment means so that the substantially pre-cut yet detachably attached cards may be printed after cutting but prior to detachment.

Another object of the invention is the provision of an expendible article of manufacture which may be utilized as the base from which other products may be produced through use of personal computers and printers responsive to instructions from such personal computers whereby such other products may be imprinted with selected indicia in a professional manner and at a cost orders of magnitude less than is usually the case.

Still another object of the invention is the provision of a method for producing as an article of manufacture a base product that may be utilized, in conjunction with a computer program and a printer controlled by the computer program, to produce professionally appearing business cards, announcement cards such as for weddings, invitation cards, name cards and index cards of many different types and for many different purposes.

A still further object of the invention is the provision of a method and article of manufacture that enables the production of the above-enumerated products at a cost and within a time frame much less than is usually the case.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the invention in one of its aspects comprises an article of manufacture constituting a substantially flat planar sheet of material on which is defined at least one area smaller in size than the planar sheet of material, and having predetermined perimeter dimensions and configuration determined by one or more changes in direction of the perimeter. Means in the form of integral attachments are provided at selected ones of the occurrences of changes in direction of the perimeter detachably attaching the smaller defined area to the main planar sheet of material from which the smaller area is formed or defined by elongated slits constituting complete severance of the smaller area from the main planar sheet except at the locations where a change of direction, occurs and there is present the means integrally yet frangibly attaching the smaller area to the primary planar sheet.

In another aspect, the invention comprises the method of utilizing the article of manufacture in concert with a personal or other computer and a printer controlled by the computer through an appropriate computer program to effect the printing on each, or selected ones, of the smaller areas defined on the primary planar sheet of selected indicia that converts the smaller area into a subsidiary article of manufacture having immediate utility for the purpose intended. In this aspect of the invention, the substantially flat primary planar sheet of material, on which have been defined by pre-cutting yet remain integrally yet frangibly attached smaller areas to be printed, is fed intact after pre-cutting and before the smaller areas are detached, into a laser or other printer connected to a computer into which has been loaded an appropriate computer program by which the computer is instructed what, how, where and in what sequence to print indicia on the smaller defined areas of the intact pre-cut substantially flat planar sheet of material. Following printing of the small areas on the intact pre-cut flat planar sheet, the small areas may be detached for appropriate use for their intended purpose. By this method, and with the article of manufacture in hand, a business may print its own special size documents without the need of going to an outside printing company. The invention thus adds flexibility and speed to a market that historically is slow and static because of the relatively small volume of specialized documents required.

BRIEF DESCRIPTION OF THE DRAWINGS

FIG. 1 is a plan view illustrating a single article of manufacture constituting a substantially flat primary planar sheet of material after pre-cutting to define two smaller subsidiary areas within the boundaries of the flat primary planar sheet of material boundaries of the flat;

FIG. 2 is a horizontal sectional view taken in the plane indicated by the line 2—2 in FIG. 1.

FIG. 3 is a vertical sectional view taken in the plane indicated by the line 3—3 in FIG. 1.

FIG. 4 is a vertical sectional view taken in the plane indicated by the line 4—4 in FIG. 1.

FIG. 5 is a horizontal sectional view taken in the plane indicated by the line 5—5 in FIG. 1.

FIG. 6 is a fragmentary plan view in enlarged scale of the area in FIG. 1 surrounded by the line 6 and illustrating one relationship between the slits of complete severance and the associated lines of flexibility.

FIG. 7 is a fragmentary plan view in enlarged scale of the area in FIG. 1 surrounded by the line 7 and illustrating another relationship between the slits of complete severance and the associated lines of flexibility.

FIG. 8 is a bottom plan view of the cutting die that produces the article of manufacture as illustrated in FIG. 1.

FIG. 9 is a horizontal cross-sectional view taken in the plane indicated by the line 9—9 in FIG. 8.

FIG. 10 is a horizontal cross-sectional view taken in the plane indicated by the line 10—10 in FIG. 8.

FIG. 11 is a vertical cross-sectional view taken in the plane indicated by the line 11—11 in FIG. 8.

FIG. 12 is a vertical cross-sectional view taken in the plane indicated by the line 12—12 in FIG. 8.

FIG. 13 is an enlarged fragmentary top plan view of the area of the die illustrated in FIG. 8 that is surrounded by the line 13.

DESCRIPTION OF THE PREFERRED EMBODIMENT

Figure 14:
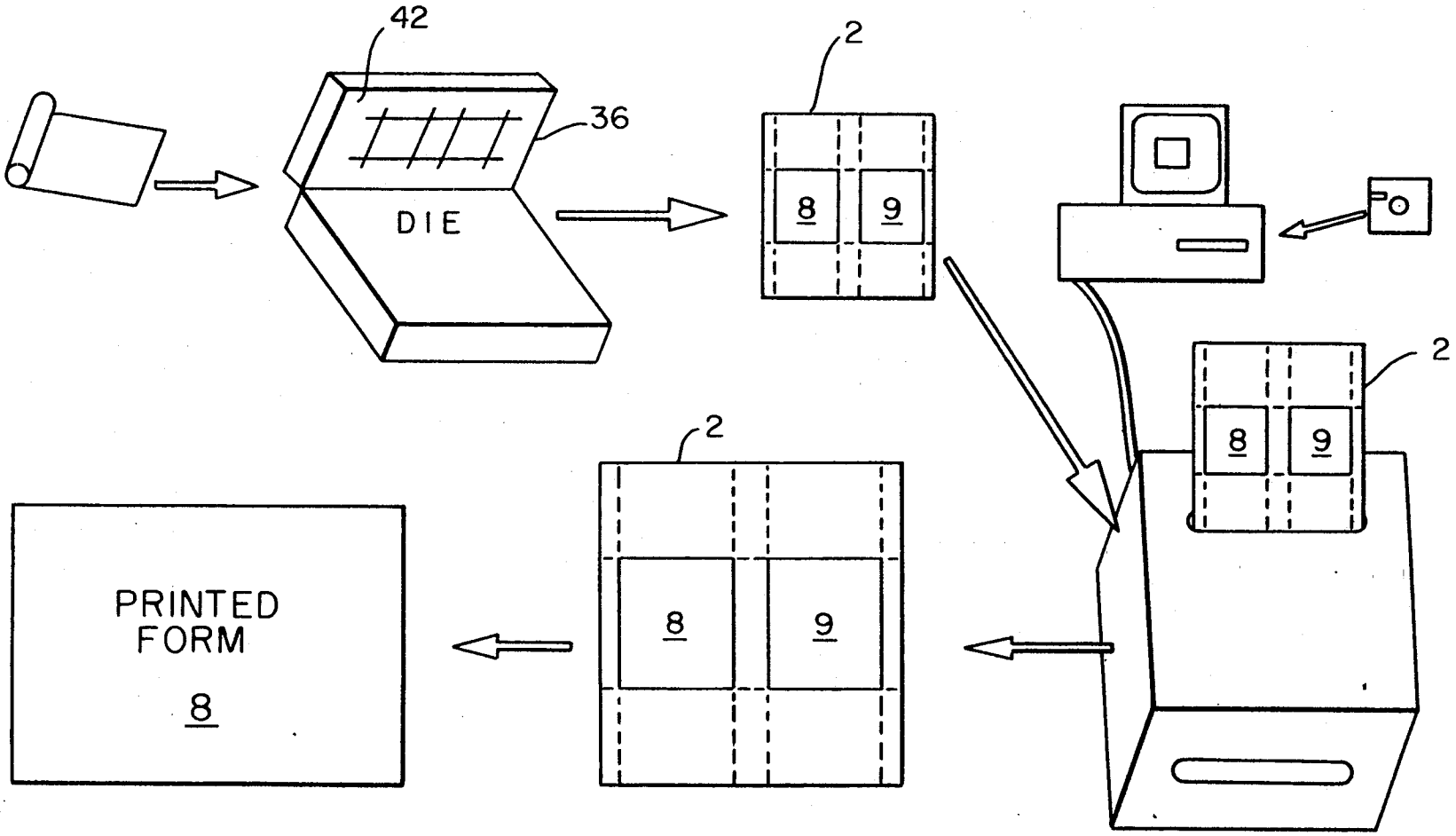
FIG. 14 is a block diagram illustrating the method of utilization of the article of manufacture illustrated in FIG. 1 in concert with a computer and printer to produce a printed end product for the consumer.

In terms of greater detail, and by way of background to indicate the utility of the invention disclosed and claimed herein, many businesses own both personal and business computers and printers that are used to produce and process the companies' business documents, reports, newsletters and other paperwork required to be produced and processed in the operation of the business.

Most business documents are printed on standard size paper having smooth edges about its perimeter. Thus, some of the conventional sizes of paper used in business include the popular letter-size 8½"×11"; the legal size 8½"×14"; and other sizes both smaller and larger that are either measured in inches or in centimeters. All of these papers are manufactured by paper producers to have smooth edges when produced as individual sheets. Some papers are now manufactured in pack or roll form with lines of perforations along marginal long edges to connect the body of the paper to a "tractor" portion utilized to draw the paper continuously through a computer-controlled printer having a tractor paper feed. Transverse lines of perforations are provided in the pack or roll of paper at longitudinally spaced intervals to enable transverse division of the pack of paper into separate sheets, or to facilitate folding of the now printed paper into a roll or flat pack. While improvements have been made in the lines of perforations in such papers, it remains possible to visually detect the "roughness" of the edges of such papers torn along the lines of perforations.

Heretofore, to my knowledge, the prior art has not addressed the problem of producing, from a relatively large standard size sheet of material capable of being run through a conventional printer controlled by a computer, a relatively smaller off-size document having smooth edges and that is pre-defined on the larger planar sheet by pre-cut smooth edges and printed in pre-cut form as it passes through the computer-controlled printer.

Businesses have thus largely been limited to the following choices where non-standard size documents are desired:

1. Find a standard size sheet of material having an area of the needed size and configuration that is pre-printed and subsequently defined by a series of closely spaced perforations. This solution permits detachment of the pre-printed subsequently perforated smaller area from the standard size sheet but it does not produce a smooth edge, and is not usually used with card stock materials.

2. Find a standard size sheet where the desired smaller size area is mounted on an adhesive backing, i.e., label paper, and "kiss-cut", the smaller size document then being removable from the adhesive backing. This procedure produces a smooth edge on the smaller size document, but requires a backing, is not done with heavy materials such as card stock, and has the disadvantage that small bits of adhesive may adhere to the cut form.

3. Find a suitable standard size sheet, print the non-standard document on the sheet, then bend and cut the document to the non-standard size. This procedure produces a relatively smooth edge as compared to a perforation cut, but takes a great deal of time, and does not look professional.

4. Find a standard size sheet of material, print the non-standard size document on the full sheet, then cut the non-standard size document from the standard size sheet. This procedure produces a smooth edge, but requires great care, takes time, is wasteful of material and does not look professional.

5. Go to a professional printer for creation of the non-standard size document. This is professional, the cost is high for emergency documentation, the time frame for delivery may not be acceptable, and a small number of documents to fill an immediate need, say fifty (50) or less, would probably cost as much as many times this number.

The subject matter of this invention thus provides businesses and individuals with the capability of obviating most if not all of the disadvantages implicit in the scenarios described above by placing in their hands an article of manufacture that at a moments notice can be converted into multiple non-standard size printed documents that are needed.

Referring to FIGS. 1 through 7, inclusive, it will there be seen that the preferred embodiment of the article of manufacture comprises a substantially flat primary planar sheet of material designated generally by the numeral 2, having top and bottom edges 3 and 4, respectively, and left and right side edges 6 and 7, respectively. The flat planar sheet of material is preferably formed from a suitable high quality paper or card stock of appropriate thickness suited to the end use of the non-standard size document to be formed, but may also be formed from other materials such as metal foil and synthetic resinous materials in sheet form on which printing may be effected with a computer-controlled printer.

Structurally, as indicated in FIGS. 1 through 7, the primary or base flat planar sheet of material is processed to provide two laterally juxtaposed subsidiary flat planar sheet portions 8 and 9 contained within the outer boundaries of the primary or base sheet and initially forming a cohesive and integral part thereof, but ultimately constituting the non-standard size document on which selected indicia is to be printed subsequent to definition of the boundaries of the subsidiary flat planar sheet portions in a manner which will now be explained.

Each of the subsidiary flat planar sheet portions 8 and 9 is defined by smooth top and bottom edges 12 and 13, respectively, and smooth left and right side edges 14 and 16 formed by cutting uninterrupted smooth elongated and transversely extending slits 17 and 18, respectively, each having opposite ends 19 and 21, as shown, that terminate at predetermined points short of the side edges 6 and 7 to thus define the width of marginal zones 22 and 23 on the flat planar base sheet, and terminate short of a median zone centrally disposed between the two subsidiary portions 8 and 9 to thus define the width of a centrally disposed longitudinal draw path designated generally by the numeral 24 and extending between the end edges 3 and 4 as shown. In some circumstances, determined by the construction and operation of a particular printer, the laterally spaced marginal zones 22 and 23 may also function as parallel draw paths.

The lateral boundaries of the subsidiary flat planar base sheet portions 8 and 9, that ultimately will form the special non-standard size document desired, are formed by smooth slits 26 and 27 that extend longitudinally of the base sheet, and cut cleanly through the sheet for the full length of each slit, but just short of the full length of the subsidiary non-standard size document 8 and 9 to be formed, each slit terminating in opposite ends 28 and 29 spaced from the end edges 3 and 4 of the base sheet as shown, but more importantly these opposite ends 28 and 29 terminate spaced from the associated ends 19 and 21 of the end slits 17 and 18 by a sufficiently small amount that the slits do not in fact intersect but would if they were extended. Thus, there is left intact at each corner of the non-standard size document 8 and 9 a small portion or "dot" 31 of base sheet material that functions to integrally yet frangibly connect the subsidiary sheet portion to the base sheet, thus retaining the subsidiary sheet portion in planar alignment with the base sheet so that when the base sheet, now appropriately slit to define the non-standard sheet portions 8 and 9, is drawn through the computer-controlled printer, the sheet portions 8 and 9, and any others defined on the sheet, will maintain their exact position during the printing process.

By virtue of the constraints placed on the longitudinal edges of the base sheet by the printer mechanism, the subsidiary portions 8 and 9, frangibly attached integrally as they are to the base sheet, will be individually printed with the indicia dictated by the computer program, and the subsidiary sheet portions 8 and 9 will be mirror images of each other. Following the printing process, the subsidiary sheet portions 8 and 9 may be easily detached from the base sheet to thus produce a utilitarian consumer article of manufacture, such as a business card, wedding announcement, name tag or other end product suitable for a given occassion. I have found that it is preferable that the "dot" 31 of material be left attached to the base sheet when the subsidiary portion 8 or 9 is detached, thus producing a practically visually imperceptible "rounding" of each of the corners of the detached portions 8 and 9. To secure this effect, for instance in a fibrous card stock having a thickness of 0.075 inches, I have found that a small "dot" 31 of base sheet material having a transverse dimension of approximately one (1) to two (2) millimeters, corresponding to approximately 0.03937 to 0.07874 inches, provides the strength needed to retain the subsidiary portions intact with the base sheet as it is drawn through the printer, while being sufficiently frangible to enable relatively easy detachment of the subsidiary portions from the base sheet.

In some instances, printers associated with computers and controlled thereby require that the copy being produced be wrapped to some degree about a cylindrical roller as it is drawn into or dispatched from the copy machine. Since many copiers are designed to handle rather flexible material, be it paper, foil, or plastic, the use of a considerably less flexible card stock such as may be used to produce business cards, for example, may cause problems with the planar base sheet being drawn through the copy machine. To obviate this problem, it is preferred that the planar base sheet of material be provided with flexibility lines or "breaks" 32 as shown, each of the flexibility lines 32 being formed by compression of the base sheet material along the line desired, each compression line reducing the thickness of the base sheet material without cutting the material, thus rendering the sheet material substantially more flexible along the flexibility lines than at other locations on the base sheet.

As seen in FIGS. 1 through 7, the flexibility lines 32 are in virtually non-severing alignment with the associated slits formed in the base sheet. Thus, referring to the upper portion of FIG. 1, it will be seen that the flexibility lines 32 are aligned with transversely extending slits 17 and with vertically extending slits 26 and 27. The same relationship is true at the bottom of the base sheet as seen in FIG. 1, where the flexibility lines 32 are aligned with transversely extending slits 18 and vertically extending slits 26 and 27. Thus, if the planar base sheet of material is fed into a printer or copy machine so that the top edge 3 is the leading edge, for instance, the transversely extending flexibility lines 32 that extend across the marginal zones 22 and 23 in alignment with the slits 17 and 18 would enable the sheet to more easily be wrapped to some degree about a cylindrical roller, if that was necessary. On the the other hand, if either of the lateral edges 6 or 7 is fed into the copy machine as the leading edge, the flexibility lines aligned with the slits 26 and 27 would increase flexibility of the sheet and enable wrapping to some degree of the sheet about a roller. Obviously, where the base sheet passes through the printer or copy machine in a flat planar mode, the flexibility lines are superfluous, but provide versatility to the article of manufacture in that it may be used in many more types of printers.

In FIG. 1 I have illustrated the article of manufacture as comprising a planar base sheet of material on which only two subsidiary non-standard size documents 8 and 9 are defined. It should be understood that such a presentation is made merely for purposes of illustration, and that many more non-standard size documents may be defined on the planar base sheet in the manner described above. The number of such non-standard size documents that may be defined on the planar base sheet is determined only by the size of the base sheet and the size and number of the documents to be defined on the base sheet.

Referring now to FIGS. 8 through 13, there is shown in FIG. 8 a bottom plan view of the forming die that is used to form the article of manufacture illustrated in FIG. 1. The die is formed from a generally rectangular metal member designated generally by the numeral 36, and having top and bottom edges 37 and 38 that correspond generally to the top and bottom edges 3 and 4, respectively, of the article of manufacture illustrated in FIG. 1. In like manner, the lateral edges 39 and 41 of the die 36 correspond to the lateral edges 6 and 7, respectively, of the article of manufacture.

The top, bottom and lateral side edges of the die 36 define a forming face designated generally by the numeral 42 from which project sharp knife edges 43 and 44 extending vertically between the top and bottom edges of the die as shown, and arranged on the face of the die to correspond in placement to the spacing of the slits 26 and 27 formed in the article of manufacture shown in FIG. 1. In like manner, there is provided projecting from the forming face 42 of the die sharp knife edges 46 and 47 extending transversely across the face of the die between the lateral side edges thereof, and corresponding in placement and spacing to the transversely extending slits 17 and 18 formed in the article of manufacture.

Referring to FIG. 8, and particularly to FIG. 13 which illustrates an enlarged fragmentary bottom plan of the area of the forming face indicated in FIG. 8 by the circular line 13, it will be seen that the opposite ends 48 and 49 of the sharp knife edges 43 and 44 are spaced from the associated opposite ends 51 and 52 of the knife edges 46 and 47. This leaves a very small area 53 disposed at the level of forming face 42, and disposed also between the adjacent and associated ends of the knife edges. Since the knife edges do not extend into this area, this very small area corresponds to the uncut area or "dot" 31 of the base sheet that lies between the adjacent and associated ends of the slits formed in the base sheet where a change of direction of the perimeter of the non-standard subsidiary sheet portion occurs.

The forming face 42 of the die is also provided with non-cutting raised bars 54 appropriately positioned and projecting from the face of the die so as to impose a prescribed pressure on the planar base sheet of material to form the lines of flexibility 32 illustrated in FIGS. 1–8. As shown in FIG. 13, the non-cutting raised bars 54 project from the face 42 of the die a lesser extent than the knife edges and the exposed edges are rounded. The reason for this is that it is not desired that the bars 54 cut the base sheet material. Rather, all that is desired is that the raised bars impose a compressing force on the sheet material for the purpose of weakening the sheet material long the line formed by the bar so as to increase the flexibility of the sheet along the flexibility lines.

Referring to FIG. 8, it will be seen that the compression bars 54 extend from adjacent the ends 48 and 49 of knife edges 43 and 44 toward the associated top and bottom edges 37 and 38, respectively, and from adjacent the ends 51 and 52 of the knife edges 46 and 47 toward the associated left and right side edges 39 and 41, respectively. It should be noted that the compression bars 54 are in alignment with the knife edges with which they are associated, but the associated ends of the compression bars are spaced from the adjacent ends of the associated knife edges. This is important because it leaves undisturbed the area 53 for the definition of the "dot" 31 of sheet material that detachably attaches the subsidiary sheet portions 8 and 9 to the remainder of the base sheet.

It is also important to note that in the preferred embodiment of the die illustrated in FIG. 8, there is an elongated area 56 defined by top and bottom edges 37 and 38 of the die, the parallel spaced knife edges 43 and 44 adjacent to but on opposite sides of a median plane passing through the die, and the compression bars 54 extending in alignment with the knife edges 43 and 44, that corresponds to the draw path 24 as seen in FIG. 8. Additionally, it should be noted that compression bars 54 extend transversely across the elongated area 56 between the associated ends 51 and 52 of the knife edges 46 and 47.

It should be understood that the elevation of the knife edges above the forming face 42 of the die is gauged to perform a "kiss-cut" of the planar sheet of material when the die is pressed against the sheet of material which is of course solidly supported on its back side. In like manner, the non-cutting compression bars 54 are gauged in height above the forming face 42 to compress a line in the sheet of planar material to thus reduce the thickness of the material along the line and render it more flexible, but does not cut the base sheet material. Following processing in the manner described above, the planar sheet of material is packaged with other like sheets to form a kit which, together with an appropriate computer program, also forming a part of the kit, may be used in conjunction with a personal or other computer to print selected indicia on the subsidiary sheet portions 8 and 9 defined in the base sheet by the cutting process.

In that regard, reference is had to FIG. 14 of the drawings which illustrates in block diagram form the equipment and the process for forming and printing the article of manufacture in planar sheet form with selected indicia accurately printed on the slit-defined subsidiary portions of the base sheet so that following printing, the appropriately printed slit-defined subsidiary sheet portions may be detached from the base sheet of material for ultimate use by a consumer. As there shown, a planar sheet of base material of predetermined standard size, such as paper, foil, or plastic, either in roll form cut to predetermined length, or in individual sheet form, is fed into the die, which is operated to cut the standard size sheet so as to produce the slits therein that define the subsidiary sheet portions that will subsequently be printed. The operation of the die also effects formation of the flexibility lines in the standard size planar base sheet of material. The now pre-formed, i.e., die-cut standard sheet of material with the subsidiary sheet portions defined by slits but still attached to the base sheet is removed from the die and fed into a computer controlled printer equipped with a computer program that has been designed to enable the computer operator to design in the computer and display on the computer monitor, the precise indicia intended to be printed on the subsidiary sheet portions defined by the slits. Having designed the format and content of the indicia to be printed, the computer is commanded to print the pre-cut planar sheet of material, which passes through the printer and exits as a printed planar sheet, with all the subsidiary sheet portions still intact but now printed with the selected indicia. The printed subsidiary sheet portions of the planar sheet are then detached from the planar sheet to produce the consumer end product, in whatever form has been selected.

Having thus described the invention, what is believed to be new and novel and sought to be protected by letters patent of the United States is as follows.

I claim:

1. An article of manufacture, comprising:

a) a substantially flat primary planar sheet of material of predetermined thickness having top, bottom, left and right side boundary edges;

b) at least one subsidiary sheet portion smaller in size than said primary planar sheet of material but of the same predetermined thickness thereof and lying in planar alignment therewith within the boundary edges of said primary planar sheet and having predetermined perimeter dimensions and configuration determined by one or more changes in direction of said perimeter;

c) elongated slits formed in said primary planar sheet of material and constituting complete severance of perimeter portions of said at least one subsidiary sheet portion from said primary planar sheet of material between said changes in direction of the perimeter thereof; and d) means at selected ones of said changes of direction frangibly attaching integrally said at least one subsidiary sheet portion to said planar sheet of material, whereby the perimeter of said at least one subsidiary sheet portion is defined by said slits of complete severance except at said changes in direction where said means of frangible attachment integrally join said at least one subsidiary sheet portion to said planar sheet of material.

2. The article of manufacture as defined in claim 1, wherein a plurality of said subsidiary sheet portions in planar alignment are defined within the boundary edges of said primary planar sheet of material by elongated slits of complete severance extending uninterrupted between said means of frangible attachment of the perimeter of each subsidiary sheet portion to said primary planar sheet.

3. The article of manufacture as defined in claim 2, wherein a draw path forming an integral part of said primary planar sheet is defined on said primary planar sheet extending between said top and bottom end edges and enabling said primary planar sheet to be drawn through a conventional computer-controlled printer for imprinting on said plurality of subsidiary sheet portions selected indicia controlled by said computer, said plurality of subsidiary sheet portions frangibly attached to said primary planar sheet being distributed on opposite sides of said draw path and having imprinted thereon by said printer selected indicia after said subsidiary sheet portions of said primary planar sheet are defined by said elongated slits and said means of frangible attachment located at said changes in direction of the perimeter thereof.

4. The article of manufacture as defined in claim 1, wherein lines of flexibility constituting lines of diminished thickness of said primary planar sheet material are formed in said primary planar sheet of material extending transversely thereacross between said side edges and aligned with but spaced from associated slits, whereby said primary planar sheet of material having said at least one subsidiary sheet portion defined thereon by slits of complete severance disposed between said means of frangible attachment will flex at said lines of flexibility when drawn around a roller having a curved surface.

5. The article of manufacture as defined in claim 4, wherein said lines of flexibility extend transversely across said draw path.

6. The article of manufacture as defined in claim 2, wherein said plurality of subsidiary sheet portions defined within the boundary edges of said planar sheet of material are each rectangular in configuration defined by four corners, and said means integrally frangibly attaching each said subsidiary sheet portion to said planar sheet of material are located at said four corners, said elongated slits constituting lines of complete severance extending uninterrupted between said means of frangible attachment.

7. The article of manufacture as defined in claim 6, wherein each said means of integral frangible attachment associated with each said subsidiary sheet portion and located at a corner thereof is formed by the associated spaced ends of perpendicularly associated elongated slits defining lines of complete severance which, if extended, would intercept one another.

8. The article of manufacture as defined in claim 7, wherein a plurality of said elongated slits defining lines of complete severance of a major portion of the perimeter of each said subsidiary sheet portion from said primary planar sheet extend generally transversely toward said side edges.

9. The article of manufacture as defined in claim 7, wherein a plurality of said elongated slits defining lines of complete severance of a major portion of the perimeter of each said subsidiary sheet portion extend generally longitudinally toward said end edges.

10. The method of producing a printed consumer product comprising the steps of:

a) loading in a computer controlled printer the article of manufacture comprising a primary planar sheet of material including one or more subsidiary sheet portions lying in the same plane as said primary planar sheet and defined by slits intercepted by integral frangible portions of said primary planar sheet;

b) loading a computer program bearing printing instructions into the computer;

c) loading into the computer indicia to be printed on each individual subsidiary sheet portion defined by slits but still frangibly attached to said primary planar sheet of material;

d) causing the computer to operate the printer to print said indicia on each subsidiary sheet portion defined on said primary planar sheet of material; and e) separating the now printed subsidiary planar sheet portions constituting the consumer product from said primary planar sheet of material by rupturing the integral frangible interconnection therebetween.

* * * * *